US007454921B2

(12) United States Patent
Eom et al.

(10) Patent No.: US 7,454,921 B2
(45) Date of Patent: Nov. 25, 2008

(54) WINDOW TYPE AIR CONDITIONER

(75) Inventors: Yoon-Seob Eom, Gyungsangnam-Do (KR); Jeong-Hwan Koo, Busan (KR); Nae-Hyun Park, Seoul (KR); Dong-Joo Han, Busan (KR); Byeong-Jo Ryoo, Gyungsangnam-Do (KR); Kyung-soo Lee, Busan (KR)

(73) Assignee: LG Electronics, Inc., Seoul (KR)

( * ) Notice: Subject to any disclaimer, the term of this patent is extended or adjusted under 35 U.S.C. 154(b) by 203 days.

(21) Appl. No.: 10/576,563

(22) PCT Filed: Sep. 16, 2004

(86) PCT No.: PCT/KR2004/002370

§ 371 (c)(1),
(2), (4) Date: Apr. 20, 2006

(87) PCT Pub. No.: WO2005/040685

PCT Pub. Date: May 6, 2005

(65) Prior Publication Data

US 2007/0028637 A1 Feb. 8, 2007

(30) Foreign Application Priority Data

Oct. 23, 2003 (KR) ..... 10-2003-0074403

(51) Int. Cl.
*F25D 23/12* (2006.01)

(52) U.S. Cl. ..... 62/262

(58) Field of Classification Search ..... 62/262, 62/263; 312/101; 454/201
See application file for complete search history.

(56) References Cited

U.S. PATENT DOCUMENTS

| | | | | |
|---|---|---|---|---|
| 3,727,421 | A * | 4/1973 | Berg | 62/262 |
| 5,193,355 | A | 3/1993 | Matsumi | 62/262 |
| 5,295,531 | A | 3/1994 | Tsunekawa et al. | 165/48.1 |
| 5,622,058 | A | 4/1997 | Ramakrishnan et al. | 62/295 |
| 6,434,962 | B1 | 8/2002 | Moretti et al. | 62/262 |

FOREIGN PATENT DOCUMENTS

| | | |
|---|---|---|
| JP | 03-199832 | 8/1991 |
| JP | 06-002888 | 1/1994 |

OTHER PUBLICATIONS

PCT Search Report dated Apr. 12, 2006.
PCT Written Opinion dated Apr. 12, 2006.

* cited by examiner

*Primary Examiner*—Melvin Jones
(74) *Attorney, Agent, or Firm*—Ked & Associates LLP

(57) ABSTRACT

A window type air conditioner comprises: a case having an indoor air suction port for sucking indoor air and an indoor air discharge port for discharging heat-exchanged air indoors; an indoor unit mounted inside the case positioned at an indoor side thus to be heat-exchanged with indoor air, and an outdoor unit mounted inside the case positioned at an outdoor side thus to be heat-exchanged with outdoor air, in which the indoor air suction port is formed at a front surface of the case and the indoor air discharge port is formed at an inclination front surface between the front surface and an upper surface of the case. According to this, indoor air smoothly flows thus to increase an air discharge amount, and a flow resistance is decreased thus to reduce noise.

11 Claims, 7 Drawing Sheets

WINDOW TYPE AIR CONDITIONER

TECHNICAL FIELD

The present invention relates to a window type air conditioner, and more particularly, to a window type air conditioner capable of reducing noise and lowering an entire height by making air discharged to an indoor side flow smoothly.

BACKGROUND ART

In general, an air conditioner is provided with a refrigerating cycle constituted with a compressor, a condenser, a capillary tube, a heat exchanger, etc., and properly supplies cool air generated from an evaporator and warm air generated from the condenser indoors according to the indoor condition, thereby maintaining the indoor circumstance comfortably.

The air conditioner is divided into a window type air conditioner and a separated type air conditioner according to an installation method. The window type air conditioner is installed at the window, etc. under the state that an outdoor unit and an indoor unit are integrally assembled in one case, and the separate type air conditioner is respectively installed at the outdoor side and the indoor side under the state that the outdoor unit and the indoor unit are separated from each other.

FIG. 1 is a disassembled perspective view showing a window type air conditioner in accordance with the conventional art, and FIG. 2 is an engagement sectional view showing the window type air conditioner in accordance with the conventional art.

The conventional window type air conditioner comprises: a case 102 of which one side is positioned at the outdoor side and another side is positioned at the indoor side;

an outdoor unit 104 installed at the outdoor side of the case 102 and heat-exchanged with outdoor air; and an indoor unit 106 installed at the indoor side of the case 102 and heat-exchanged with indoor air.

The case 102 is installed at the wall that divides the outdoor side and the indoor side, and one side of the case 102 is positioned at the outdoor side and another side thereof is positioned at the indoor side. An outdoor air suction port 108 for sucking outdoor air is formed at both lateral surfaces of the case 102 positioned at the outdoor side. Also, an outdoor air discharge port 110 for discharging the air heat-exchanged while passing through the outdoor unit 104 outdoors is formed at the rear surface of the case 108. At the front surface of the case 108 positioned at the indoor side, an indoor air suction port 112 for sucking the indoor air and an indoor air discharge port 114 for discharging the air heat-exchanged while passing through the indoor unit 106 indoors are respectively formed.

The outdoor unit 104 is composed of: an outdoor heat exchanger 120 installed inside the case 102 positioned at the outdoor side and connected to a compressor 116 by a refrigerant pipe 124 thus to be heat-exchanged with the outdoor air; and an axial fan 122 opposite to the outdoor heat exchanger 120 for generating a blowing force to suck the outdoor air and thus to discharge it to the outdoor heat exchanger 120.

The case 102 positioned at the outdoor side is provided with a shroud 126 where the axial fan 122 and the outdoor heat exchanger 120 are mounted. The shroud 126 is provided with an orifice 128 for guiding air to the axial fan 122 for a smooth suction.

As shown in FIG. 3, the indoor unit 106 is composed of: an indoor heat exchanger 130 installed inside the case 102 positioned at the indoor side and connected to the compressor 116 by the refrigerant pipe 124 thus to be heat-exchanged with the indoor air; and a centrifugal fan 132 opposite to the indoor heat exchanger 130 for generating a blowing force to suck the indoor air and thus to discharge it to the indoor heat exchanger 130.

An orifice 134 for guiding the air that has passed through the indoor heat exchanger 130 to the centrifugal fan 132 is formed between the indoor heat exchanger 130 and the centrifugal fan 132. An air guide 136 for guiding the air that has passed through the centrifugal fan 132 to the indoor air discharge port 114 is installed at the upper side of the centrifugal fan 132. Also, an air guide passage 162 for passing the indoor air by an air guide panel 160 is installed at the upper side of the centrifugal fan 132.

A division plate 150 for dividing the outdoor unit 104 and the indoor unit 106 is installed inside the case 102, and a driving motor 152 for driving the centrifugal fan 132 and the axial fan 122 is mounted at the division plate 150.

Operation of the window type air conditioner in accordance with the conventional art will be explained in more detail. When a power source is applied to the air conditioner, the compressor 116 and the driving motor 152 are driven thus to heat-exchange the outdoor air at the outdoor unit 104 and to heat-exchange the indoor air at the indoor unit 106.

More specifically, when the axial fan 122 is driven, the outdoor air is sucked through the outdoor air suction port 108 thus to be heat-exchanged while passing through the outdoor heat exchanger 120. Then, the outdoor air is discharged outdoors through the outdoor air discharge port 110.

When the centrifugal fan 132 is driven, the indoor air is sucked through the indoor air suction port 112 thus to be cooled while passing through the indoor heat exchanger 130. Then, the indoor air is discharged indoors through the indoor air discharge port 114.

Herein, the indoor air is discharged along the arrow direction, S as the centrifugal fan 132 is driven, and then is curved as much as 90°. Then, the indoor air is guided to the air guide passage 162 thus to be discharged along the arrow direction, T through the indoor air discharge port 114 formed at the front surface of the case 102.

However, in the conventional window type air conditioner, since the indoor air discharge port 114 and the indoor air suction port 112 are respectively provided at the upper and lower sides of the front surface of the case 102, air sucked from the indoor side and air discharged to the indoor side collide with each other at the front side of the case 102 and generate a flow resistance. According to this, flow noise is generated and an efficiency of the heat exchanger is lowered as the cool air discharged to the indoor air discharge port 114 is sucked into the indoor air suction port 112.

Also, since the air guide passage 162 for passing the indoor air is formed with an angle of 90°, a vortex is generated at a portion curved as 90° and a flow resistance is generated. According to this, a discharge amount of air is decreased and flow noise is generated.

Additionally, since the indoor air suction port 112 and the indoor air discharge port 114 are respectively formed at the front surface of the case 102, a suction area M that the indoor air is sucked and a discharge area L that the indoor air is discharged have to be obtained. According to this, the height H1 of the case 102 has to be maintained as a proper level and thereby the entire height of the air conditioner is increased.

DISCLOSURE

Therefore, it is an object of the present invention to provide a window type air conditioner capable of decreasing noise by reducing a collision between sucked air and discharged air by improving an indoor air discharge port for discharging indoor air, and capable of increasing an efficiency by preventing discharged air from being sucked into an indoor air suction port.

Another object of the present invention is to provide a window type air conditioner capable of increasing an air discharge amount and reducing noise by reducing a flow resistance by making indoor air flow smoothly by improving an air guide passage for guiding indoor air.

Still another object of the present invention is to provide a window type air conditioner capable of decreasing an entire height by improving an indoor air discharge port.

To achieve these objects, there is provided a window type air conditioner comprising: a case having an indoor air suction port for sucking indoor air and an indoor air discharge port for discharging heat-exchanged air indoors; an indoor unit mounted inside the case positioned at an indoor side thus to be heat-exchanged with indoor air; and an outdoor unit mounted inside the case positioned at an outdoor side thus to be heat-exchanged with outdoor air, in which the indoor air suction port and the indoor air discharge port are formed different surfaces of the case.

The indoor air suction port is formed at a front surface of the case, and the indoor air discharge port is formed at an inclination surface between the front surface and an upper surface of the case.

The indoor unit includes: an indoor heat exchanger for passing indoor air and thereby cooling; a centrifugal fan for generating a blowing force so that indoor air sucked into the indoor air suction port can pass through the indoor heat exchanger; and a shroud where the indoor heat exchanger and the centrifugal fan are mounted.

An air guide panel for guiding air discharged from the centrifugal fan to the indoor air discharge port is mounted at an upper surface of the shroud, and the air guide panel is adhered to an upper surface of the case by being perpendicularly extended from both lateral surfaces and a rear surface of the upper surface of the shroud. Also, an inclination portion adhered to the inclination surface of the case is formed at both lateral surfaces of the air guide panel.

A curved surface portion for flowing discharged air smoothly is formed at the upper end of the air guide panel mounted at the case.

BEST MODE

Hereinafter, a window type air conditioner according to the present invention will be explained with reference to the attached drawings.

Even if a plurality of preferred embodiments can exist in the present invention, the most preferred embodiment will be explained hereinafter.

Figure 1:
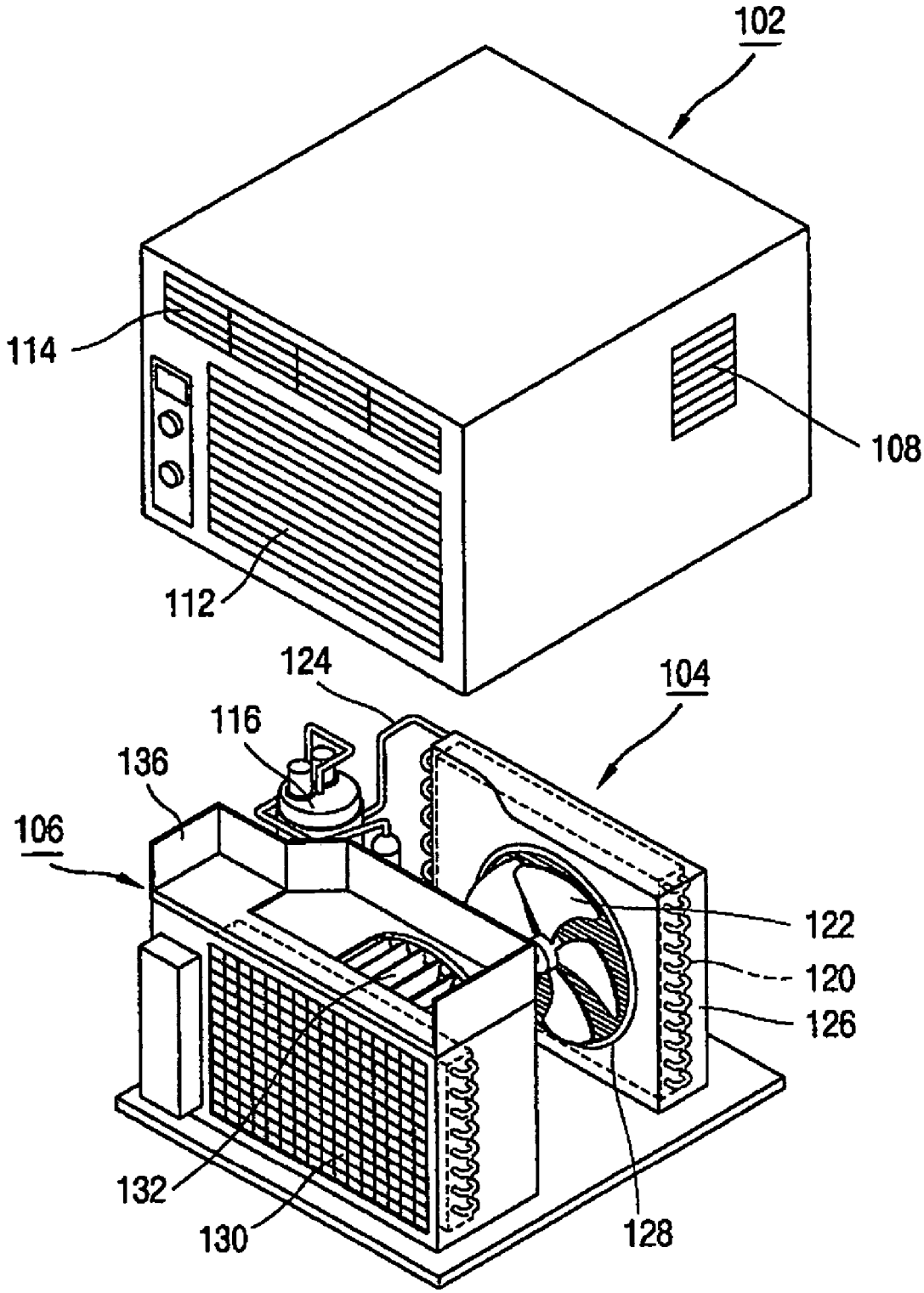
FIG. 1 is a disassembled perspective view showing a window type air conditioner in accordance with the conventional art.
Figure 2:
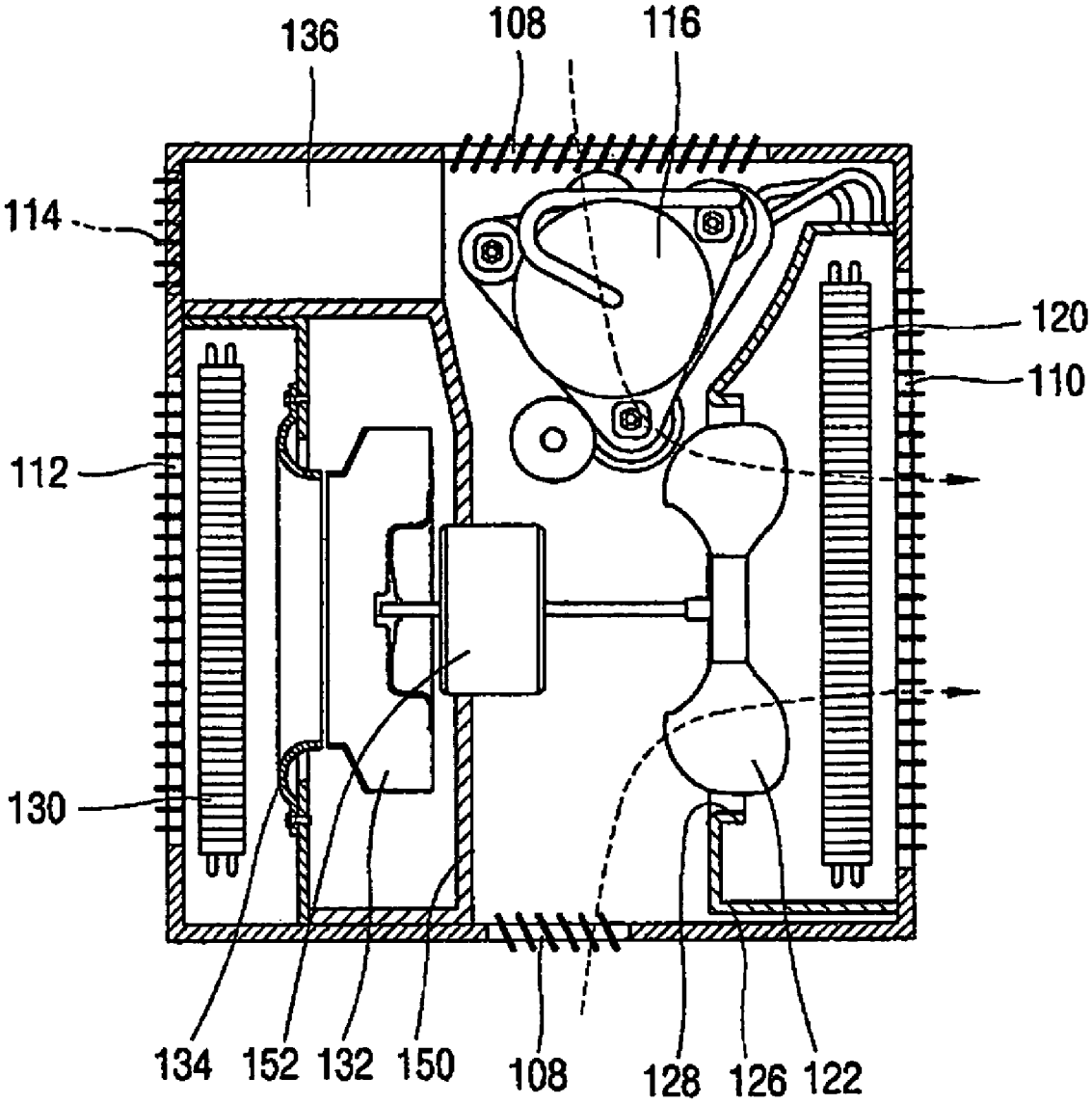
FIG. 2 is a sectional view showing the window type air conditioner in accordance with the conventional art.
Figure 3:
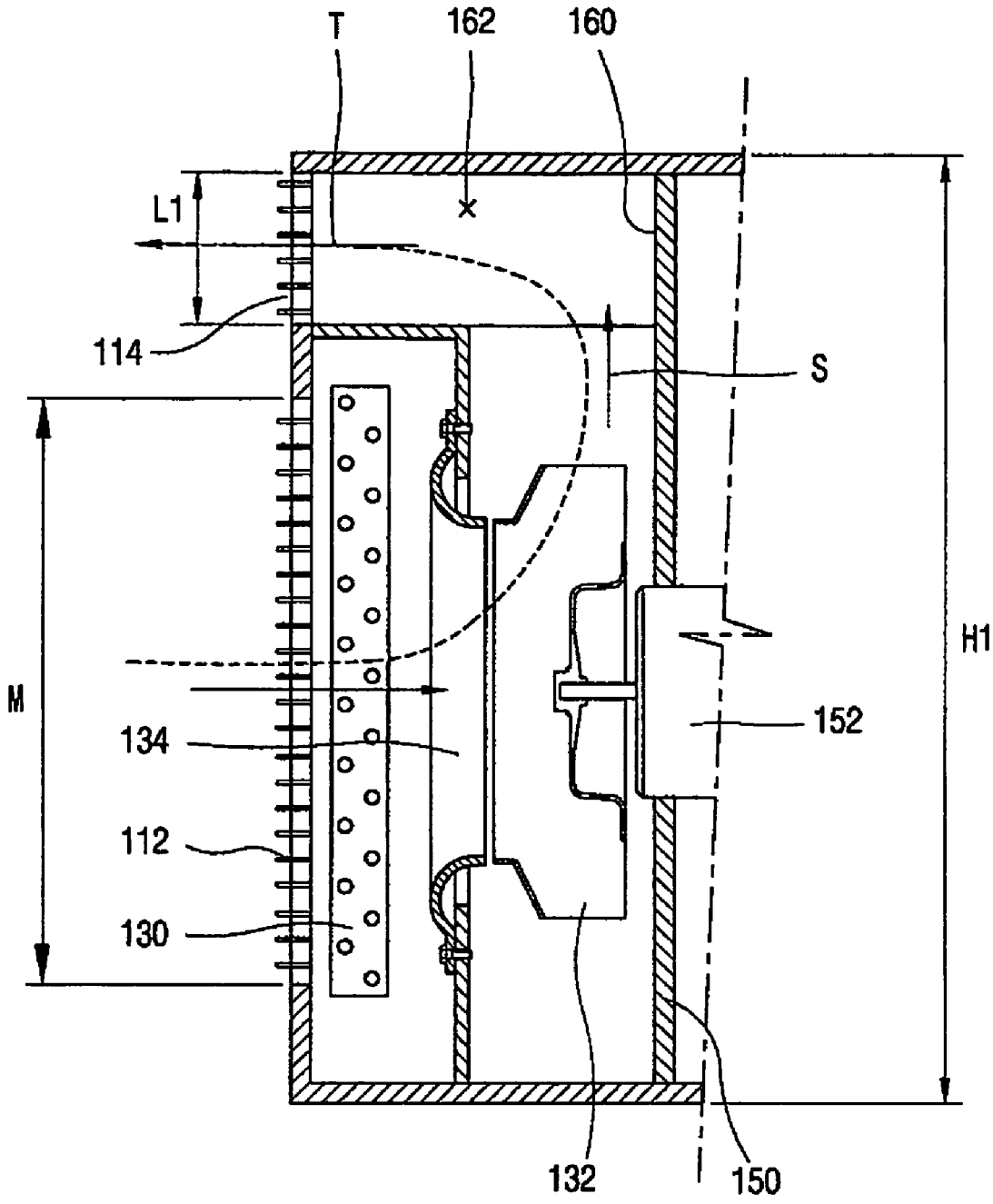
FIG. 3 is a sectional view showing an indoor unit of the window type air conditioner in accordance with the conventional art.
Figure 4:
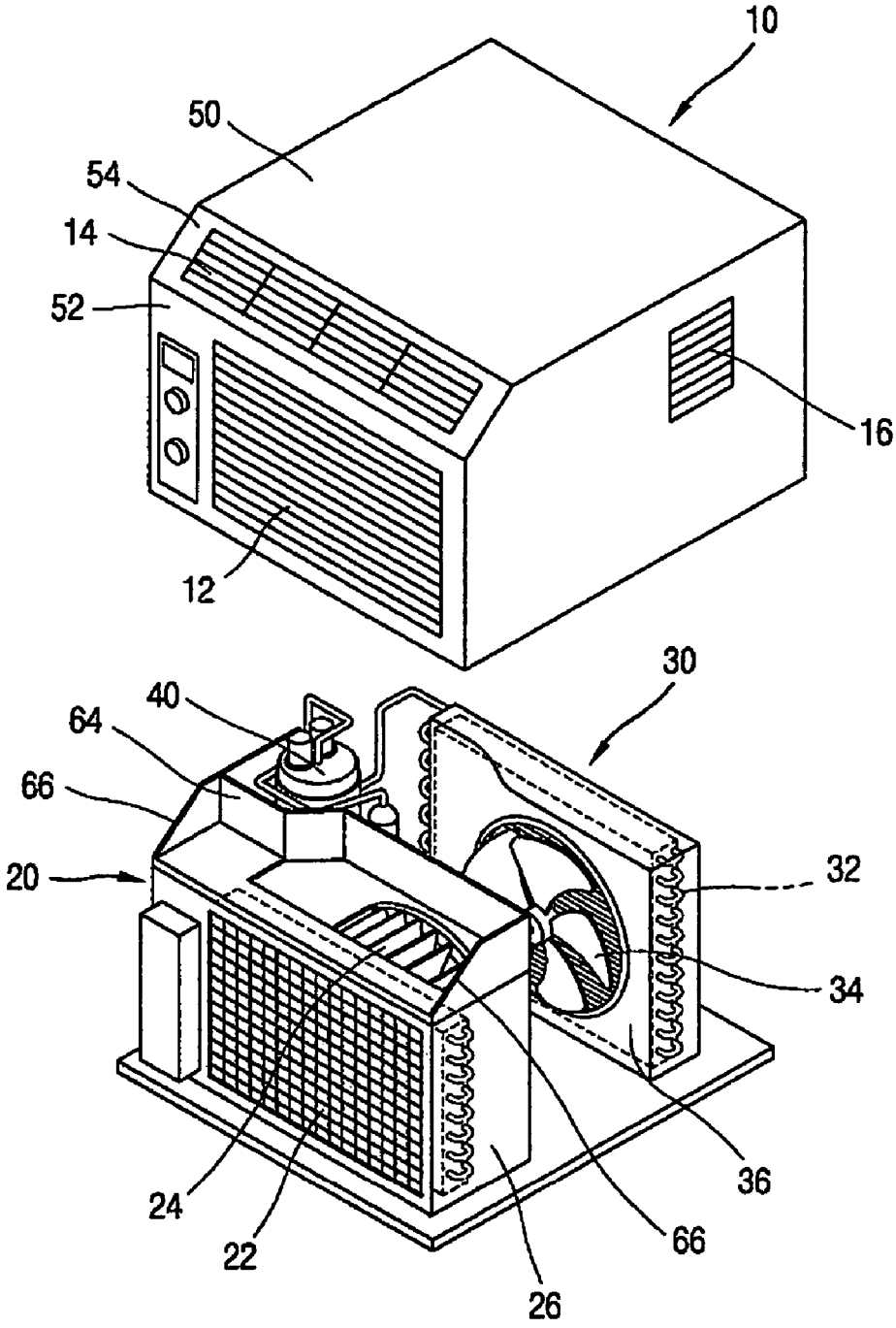
FIG. 4 is a disassembled perspective view showing a window type air conditioner according to one embodiment of the present invention.
Figure 5:
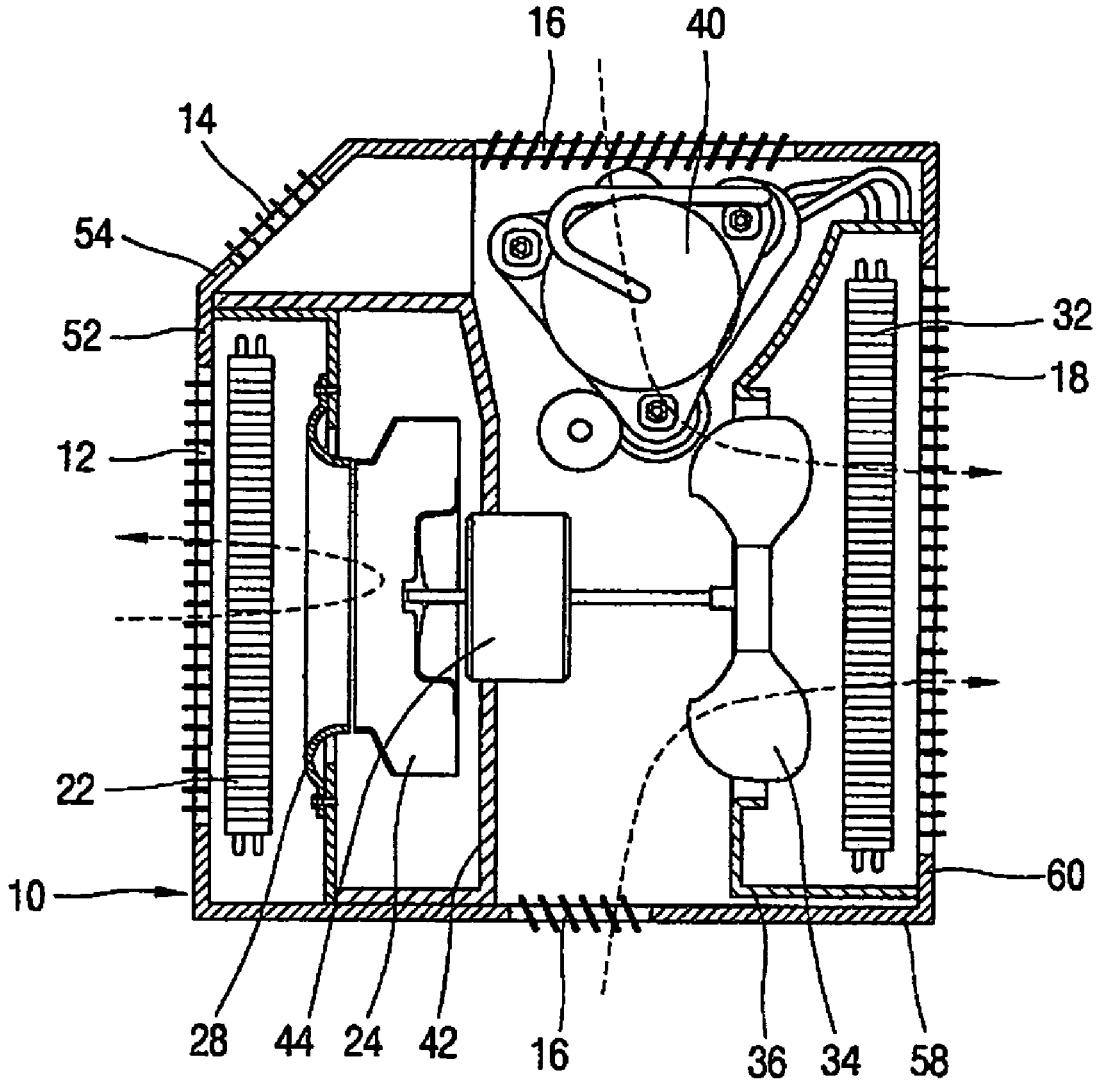
FIG. 5 is a sectional view shoving the window type air conditioner according to one embodiment of the present invention.

FIG. 4 is a disassembled perspective view showing a window type air conditioner according to the present invention, and FIG. 5 is a sectional view showing the window type air conditioner according to the present invention.

The window type air conditioner according to the present invention comprises: a case 10 arranged at a wall that divides an indoor side and an outdoor side; an indoor unit 20 arranged at the indoor side of the case 10 thus to be heat-exchanged with indoor air; and an outdoor unit 30 arranged at the outdoor side of the case 10 thus to be heat-exchanged with outdoor air; a compressor 40 for compressing a refrigerant; etc.

The case 10 has one side exposed to the indoor side, and another side exposed to the outdoor side. A division plate 42 for dividing the indoor unit 20 and the outdoor unit 30 is installed in the case 10, and a driving motor 44 is mounted at the division plate 42.

An indoor air suction port 12 for sucking indoor air is formed at a front surface of the case 10 positioned at the indoor side, and an indoor air discharge port 14 for discharging air that has been heat-exchanged while passing through the indoor unit 20 is formed between an upper surface 50 of the case 10 and the front surface 52.

An inclination surface 54 inclined with an angle of approximately 45° is formed between the upper surface 50 and the front surface 52 of the case 10, and the inclination surface 54 is provided with the indoor air discharge port 14 for discharging air indoors.

An outdoor air suction port 16 for sucking outdoor air is formed at both lateral surfaces 58 of the case 10 positioned at the outdoor side, and an outdoor air discharge port 18 for discharging air that has passed through the outdoor unit 30 outdoors is formed at a rear surface 60 of the case 10 positioned at the outdoor side.

The outdoor unit 30 includes: an outdoor heat exchanger 32 connected to the compressor 40 by a refrigerant pipe and heat-exchanged by outdoor air; an outdoor fan 34 opposite to the outdoor heat exchanger 32 and connected to another side of the driving motor 44, for generating a blowing force by which outdoor air sucked into the outdoor air suction port 16 to the outdoor heat exchanger 32.

A shroud 36 in which the outdoor fan 34 and the outdoor heat exchanger 32 are mounted is installed in the case 10 positioned at the outdoor side. The outdoor fan 34 is preferably constructed as an axial fan.

Figure 6:
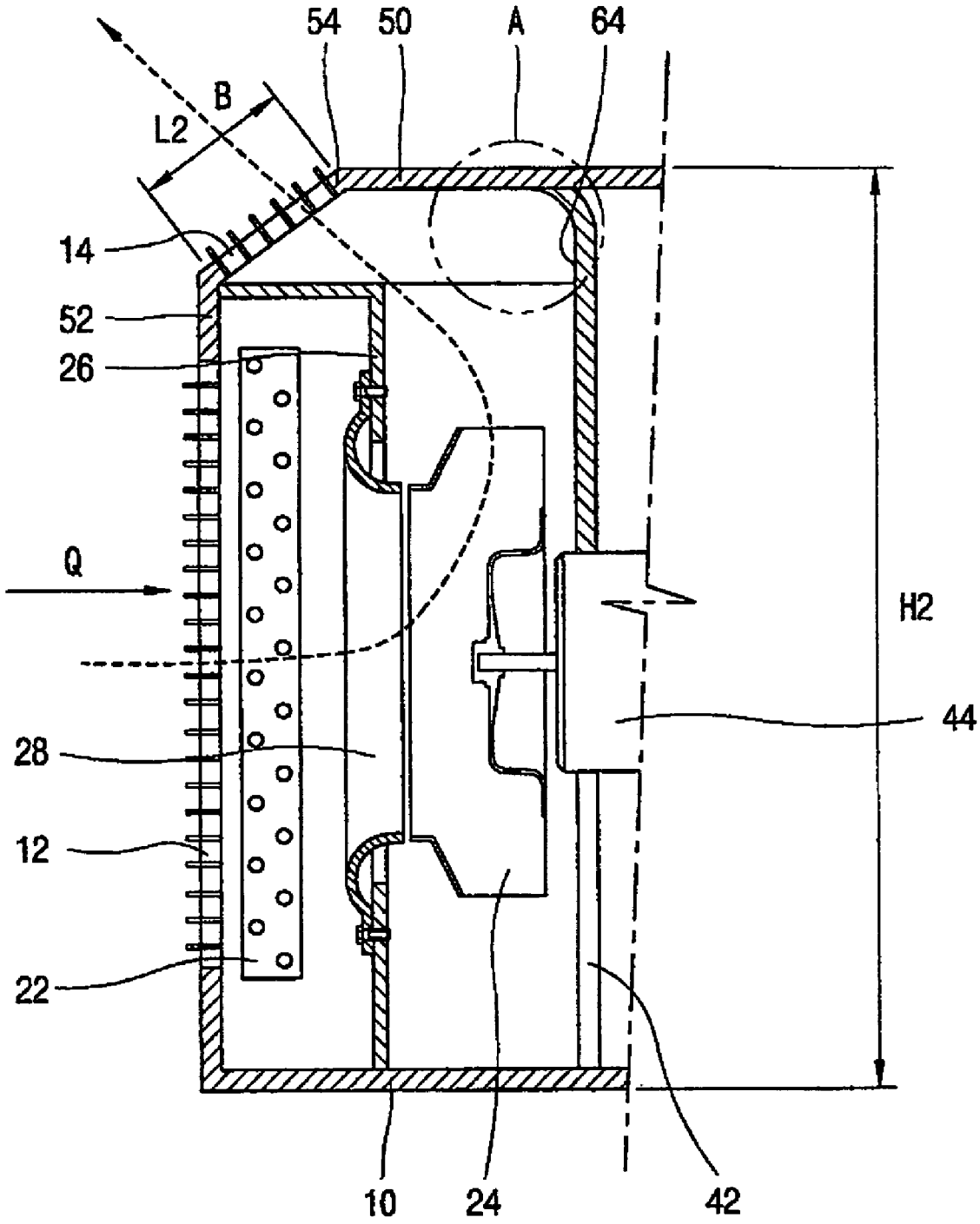
FIG. 6 is a sectional view showing an indoor unit of the window type air conditioner according to one embodiment of the present invention.

As shown in FIG. 6, the indoor unit 20 is composed of: an indoor heat exchanger 22 for passing indoor air and thereby cooling; and an indoor fan 24 opposite to the indoor heat exchanger 22 and connected to one side of the driving motor, for generating a blowing force so that indoor air sucked into the indoor air suction port 12 can pass through the indoor heat exchanger 22.

The indoor fan 24 is mounted in a shroud 26, and is preferably constructed as a centrifugal fan for discharging air sucked in an axial direction to a circumstantial direction. An orifice 28 for a smooth air flow is formed between the indoor fan 24 and the indoor heat exchanger 22.

A width L2 of the indoor air discharge port 14 formed at the inclination surface 54 between the front surface 52 and the upper surface of the case 10 is the same as a width L1 of the conventional indoor air discharge port 114 or is more than the width L1. Since the indoor air discharge port 14 is obliquely formed with an angle of 45° at the inclination surface, the height H2 of the case 10 is lower than the height Hi of the conventional case 102.

An air guide panel 64 for guiding air that has passed through the indoor fan 24 to the indoor air discharge port 14 is mounted at an upper side of the shroud 26. The air guide panel is adhered to the upper surface 50 of the case 10 by being perpendicularly extended from both lateral surfaces and a rear surface of the upper surface of the shroud 26. Also, an inclination portion 66 inclined with an angle of 45° to be adhered to the inclination surface 54 of the case 10 is formed at both lateral surfaces of the air guide panel 64.

Figure 7:
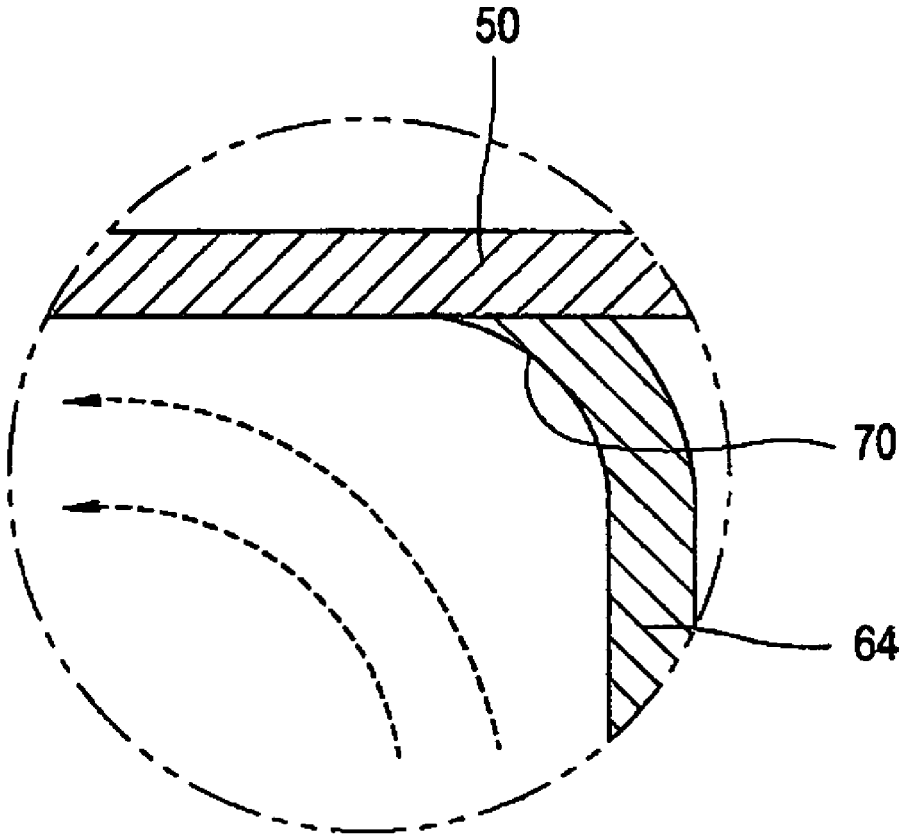
FIG. 7 is an enlargement view of 'A' part of FIG. 6.

As shown in FIG. 7, a curved surface portion 70 for making discharged air flaw smoothly is formed at the upper end of the air guide panel 64 mounted at the case 10. The curved surface portion 70 is formed as the upper end of the air guide panel 64 is curved inwardly as a curved line form, and guides air discharged in a circumferential direction of the indoor fan 24 to smoothly flow without a vortex generation.

Operation of the window type air conditioner according to the present invention will be explained as follows.

When a power is applied to the air conditioner, the compressor 40 is driven thus to circulate a refrigerant, and the indoor fan 24 and the outdoor fan 34 are driven.

The outdoor unit 30 is operated as follows. When the outdoor fan 34 is driven, outdoor air is sucked into the case 10 positioned at the outdoor side through the outdoor air suction port 16 formed at both lateral surfaces of the case 10. The outdoor air passes through the outdoor heat exchanger 32 thus to be heat-exchanged, and then is discharged outdoors through the outdoor air discharge port 18 formed at the rear side of the case 10.

The indoor unit 20 is operated as follows. When the indoor centrifugal fan 24 is driven, indoor air is sucked in the case 10 positioned at the indoor side along the arrow direction Q, a perpendicular direction to the front surface of the case 10 through the indoor air suction port 12 formed at the front surface of the case 10. The sucked indoor air passes through the indoor heat exchanger 22 thus to be cooled. Then, the cooled air is discharged in a circumferential direction of the indoor fan 24, and is guided by the air guide panel 64, thereby being discharge indoors through the indoor air discharge port 14 formed at the inclination surface 54 between the front surface and the upper surface of the case 10.

Since the curved surface portion 70 is formed at the upper end of the air guide panel 64 mounted at the case 10, air is smoothly discharged in the circumferential direction of the indoor fan 24 and thereby a vortex generation is prevented.

Also, since the indoor air discharge port 14 is inclined with an angle of 45° on the basis of the front surface of the case 10, air is discharged upwardly with an angle of 45°. According to this, air flows smoothly and a flow resistance of the air is minimized, thereby reducing noise.

In the window type air conditioner according to the present invention, the indoor air discharge port is obliquely formed with a certain angle on the basis of the front surface of the case and thereby air is discharged upwardly with an angle of 45° on the basis of the front surface of the case. According to this, a collision between discharged air and sucked air is minimized thus to reduce noise, and discharged air is prevented form being sucked into the indoor air suction port thereby to increase an efficiency of the air conditioner.

Also, the curved surface portion is formed at the air guide panel for guiding indoor air thus to make an air flow smooth. According to this, an air discharge amount is increased, and a flow resistance is reduced thus to reduce noise.

Additionally, since the indoor air discharge port is formed at the inclination surface between the front surface and the upper surface of the case, the entire height of the air conditioner is lowered.

It will be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

The invention claimed is:

1. A window type air conditioner comprising:

a case having an indoor air suction port for sucking indoor air and an indoor air discharge port for discharging heat-exchanged air indoors, wherein the indoor air suction port is formed at a front surface of the case, and the indoor air discharge port is formed at an inclined surface located between the front surface and an upper surface of the case, and wherein the inclined surface is formed at an angle of approximately 45 degrees with respect to the front surface of the case;

an indoor unit mounted inside the case positioned at an indoor side thus to be heat-exchanged with indoor air; and an outdoor unit mounted inside the case positioned at an outdoor side thus to be heat-exchanged with outdoor air.

2. The window type air conditioner of claim 1, wherein the indoor unit includes:

an indoor heat exchanger for passing indoor air and thereby cooling;

a centrifugal fan for generating a blowing force so that indoor air sucked into the indoor air suction port can pass through the indoor heat exchanger; and a shroud where the indoor heat exchanger and the centrifugal fan are mounted.

3. The window type air conditioner of claim 2, wherein the shroud is provided with an air guide panel for guiding air discharged from the centrifugal fan to the indoor air discharge port at an upper surface thereof.

4. The window type air conditioner of claim 3, wherein the air guide panel is adhered to the upper surface of the case by being perpendicularly extended from both lateral surfaces and a rear surface of the upper surface of the shroud, and an inclination portion adhered to the inclination surface of the case is formed at both lateral surfaces of the air guide panel.

5. The window type air conditioner of claim 4, wherein the air guide panel mounted at the case is provided with a curved surface portion for making discharged air flow smoothly at the upper end thereof.

6. The window type air conditioner of claim 5, wherein the curved surface portion is formed as the upper end of the air guide panel is inwardly curved as a curved line.

7. A window type air conditioner, comprising:

a case having an indoor air suction port for sucking in indoor air and an indoor air discharge port for discharging heat-exchanged air indoors, wherein the indoor air suction port is formed on a front surface of the case, and the indoor air discharge port is formed on an inclination surface located between the front surface and an upper surface of the case;

an indoor unit mounted inside the case and positioned at an indoor side of the case, wherein the indoor unit includes:

an indoor heat exchanger that cools indoor air drawn in through the indoor air suction port, a centrifugal fan that sucks indoor air into the indoor air suction port so that the indoor air passes through the indoor heat exchanger, and a shroud that surrounds the indoor heat exchanger and the centrifugal fan, wherein the shroud comprises a curved portion that acts to smoothly guide air exiting the centrifugal fan towards the indoor air discharge port; and an outdoor unit mounted inside the case and positioned at an outdoor side, wherein the outdoor unit conducts a heat exchanged operation with outdoor air.

8. The window type air conditioner of claim 7, wherein the shroud comprises an air guide panel located at an upper portion thereof, wherein the air guide panel includes the curved portion that smoothly guides air discharged from the centrifugal fan to the indoor air discharge port.

9. The window type air conditioner of claim 8, wherein the air guide panel is attached to the upper surface of the case, the air guide panel extending from lateral surfaces and a rear surface of an upper portion of the shroud.

10. The window type air conditioner of claim 9, wherein curved surfaces are located at both lateral surfaces of the air guide panel.

11. The window type air conditioner of claim 7, wherein the inclination surface is oriented at a 45 degree angle with respect to the front surface of the case.

* * * * *